United States Patent [19]

Sage

[11] 4,197,881

[45] Apr. 15, 1980

[54] DEVICES FOR CONTROLLING THE HEDDLES OF A LOOM

[75] Inventor: Paul Sage, Lyons, France

[73] Assignee: Verdol S.A., Caluire, France

[21] Appl. No.: 940,549

[22] Filed: Sep. 7, 1978

[30] Foreign Application Priority Data

Sep. 16, 1978 [FR] France ..... 77 28545

[51] Int. Cl.[2] ..... D03C 3/02

[52] U.S. Cl. ..... 139/59

[58] Field of Search ..... 139/55, 59, 64, 65, 139/68; 66/204, 207, 154 R

[56] References Cited

U.S. PATENT DOCUMENTS

| | | | |
|---|---|---|---|
| 3,186,439 | 6/1965 | Seiler | 139/59 |
| 3,451,129 | 6/1969 | Alonso et al. | 139/59 |
| 3,810,492 | 5/1974 | Lauritsen | 139/59 |
| 3,938,560 | 2/1976 | Lauritsen | 139/59 |

FOREIGN PATENT DOCUMENTS

| | | | |
|---|---|---|---|
| 2746321 | 4/1978 | Fed. Rep. of Germany | 139/59 |

*Primary Examiner*—Henry Jaudon

*Attorney, Agent, or Firm*—Dowell & Dowell

[57] ABSTRACT

The invention relates to a device for controlling the heddles of a weaving loom, comprising an assembly 1 adapted to select the heddles 12 to be actuated and which is provided to be like the feeler needle selection and push part of a Verdol-Jacquard mechanism, on the other hand the device comprises three plates 14,15,16, the latter of which is stationary and against which stops 17 of the heddles rest. The plate 15 is displaced to lock the stops between 14 and 15 then the assembly 14–15 is displaced alternately in the vertical direction to provoke the rise of the selected heddles. The invention is more particularly applied to the weaving of figured fabrics.

9 Claims, 8 Drawing Figures

Fig. 3
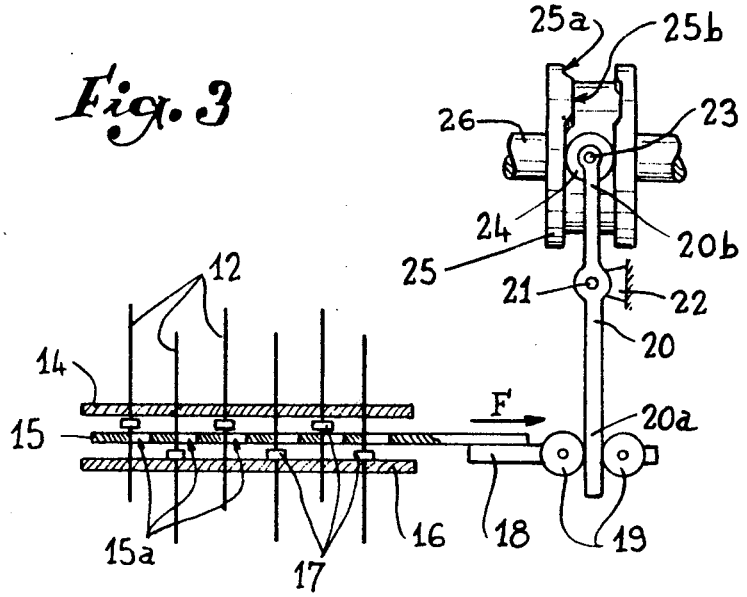
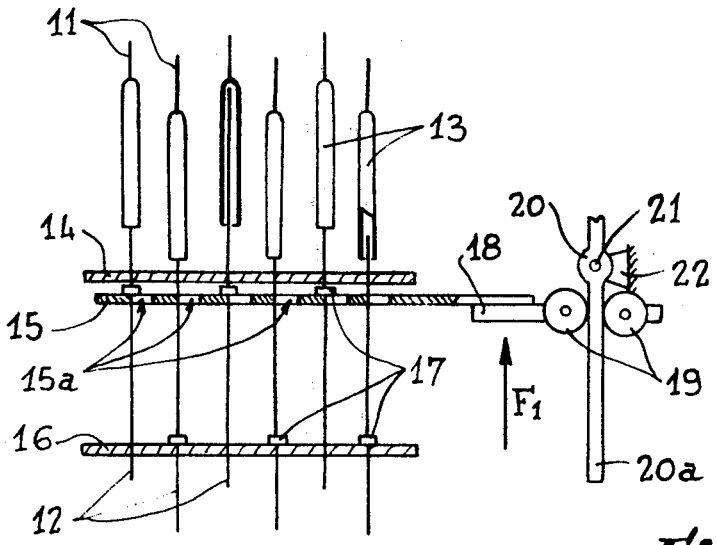
Fig. 4

DEVICES FOR CONTROLLING THE HEDDLES OF A LOOM

It is known that, to obtain patterns on a fabric, the warp threads must be raised and lowered, depending on the desired effects, to allow the passage of the weft thread; this well known operation constitutes the opening of the shed.

The opening of the shed is conventionally effected by a weave mechanism of the Jacquard or Verdol type. This mechanism effects wide-spreading movements and it must transmit fairly high forces. Such a mechanism is therefore complex and consequently expensive, and, moreover, the strokes which it must accomplish substantially limit its speed of operation.

The improvements according to the present invention envisage remedying these drawbacks. To this end, the two functions presently performed by the weave mechanism are separated by providing a first system which ensures the selection of the heddles having to lift the warp threads, and a second system which effects the opening of the shed.

The invention will be more readily understood on reading the following description with reference to the accompanying drawings, in which:

FIG. 1 is a schematic view of a device according to the invention on which the heddle actuating mechanism has not been shown.

FIG. 2 schematically shows in side view the heddle actuating mechanism.

FIGS. 3 and 4 illustrate the functioning of the translation mechanism shown in FIG. 1.

Figure 1:
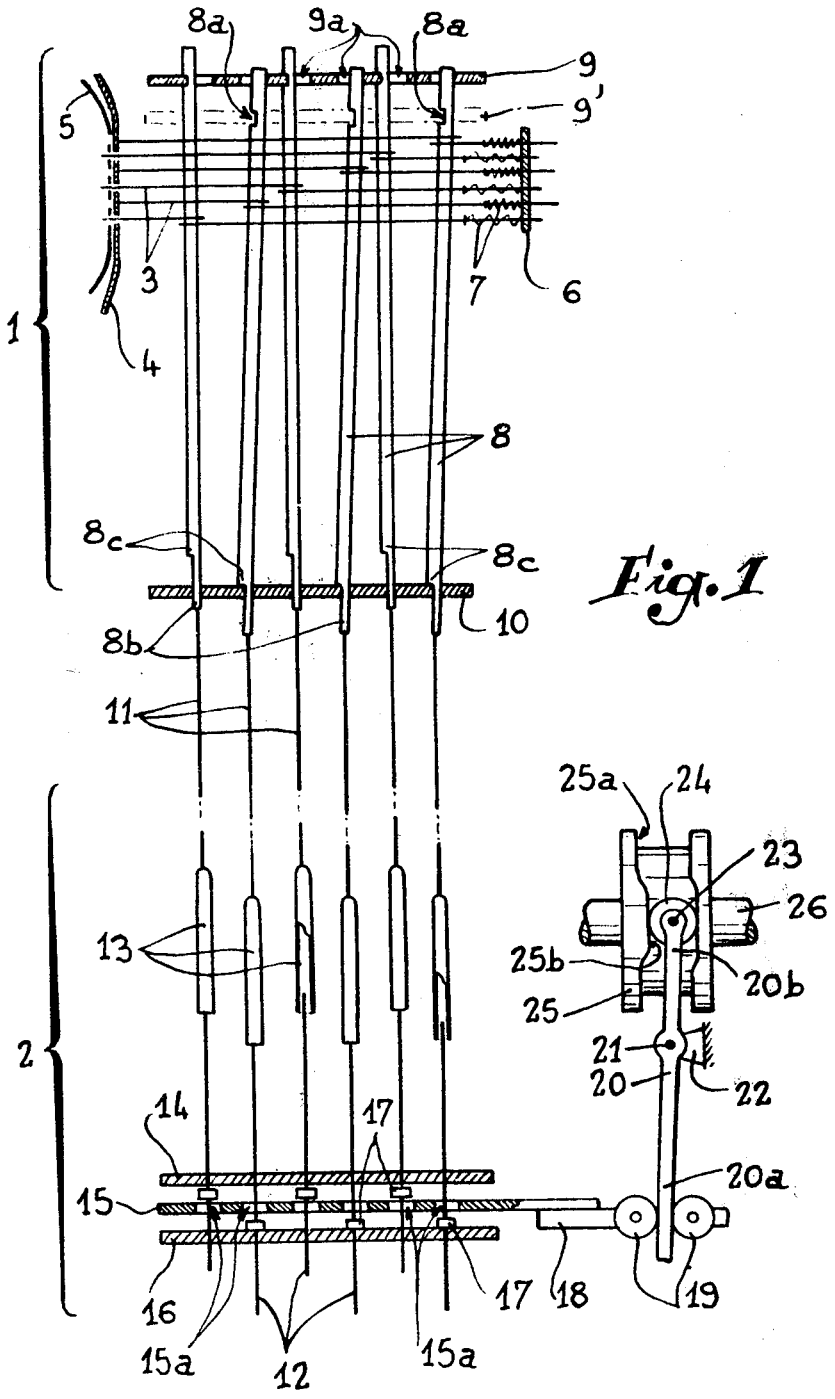

Referring now to the drawings, FIG. 1 shows a device according to the invention essentially comprising two assemblies 1 and 2 with complementary functions. Assembly 1 is established in the same manner as one of the parts of a Verdol-Jacquard mechanism. It therefore comprises a certain number of feeler needles 3 adapted to cooperate with a punched card 4 unrolling from a drum 5. The feeler needles are pushed in the direction of the drum from a fixed board 6 by means of springs 7. The feeler needles being made fast with stops or needles 8 oriented perpendicularly thereto, they move said needles towards the left when they penetrate in perforations in the card. The heads of the needles 8 pass through a thrust plate 9 through the perforations 9*a*. Each needle is provided with a notch 8*a* in which engages the edge of the corresponding perforation 9*a* of the thrust plate when the corresponding feeler needle penetrates in a perforation of the card. This is the case, in the Figure in question, of the first, third and fifth needles from the left. When the thrust plate is moved upwardly from the position 9' shown in broken lines, the needles which are fast with this plate are raised. The lower part 8*b* of the needles 8 is made thinner with a view to passing through the openings made in a stationary plate 10 and to constituting a downwardly facing shoulder 8*c* which enables the needles 8 to come into abutment against this plate when they are not actuated by the thrust plate 9.

The assembly 1 therefore selects a certain number of needles 8 as a function of the perforations of the card 4, but they do not communicate a considerable stroke to the harness cords 11 which are attached to the ends 8*b* of the needles. With each harness cord 11 there is associated a heddle 12 via an elastic telescopic system 13. Of course, each heddle is provided in known manner with a mail (not shown) through which a warp thread passes. The lower end of each heedle is fast with a system adapted to return it downwardly.

In accordance with the invention, each of the heddles successively passes through three plates 14, 15 and 16, the last of which is stationary. Each heddle is rendered fast with a stop 17 which rests against the lower plate 16 when the corresponding needle 8 is not actuated by the thrust plate 9. The perforations 15*a* through which the heddles pass in the plate 15 are provided to have such dimensions that the stops 17 may pass therethrough with clearance. It is then readily understood that the stops of the heddles which are actuated in the direction of rise by the assembly 1, are placed between the plates 14 and 15.

It is noted that the plate 15 is associated at one of its transverse ends with a fork joint 18 carrying free rollers 19 between which passes the overhanging end 20*a* of a rocking lever 20 which is provided about a shaft 21 carried by a fork joint 22 fast with the frame of the machine. The other end 20*b* of the lever 20 carries a shaft 23 about which a wheel 24 is mounted for free rotation, which wheel cooperates with the peripheral groove 25*a* of a cylindrical cam 25 rotated by a shaft 26. The groove 25 is offset over a certain length so as to form a ramp 25*b* adapted to communicate a translation to the plate 15 for reasons which will be explained hereinafter.

Figure 2:
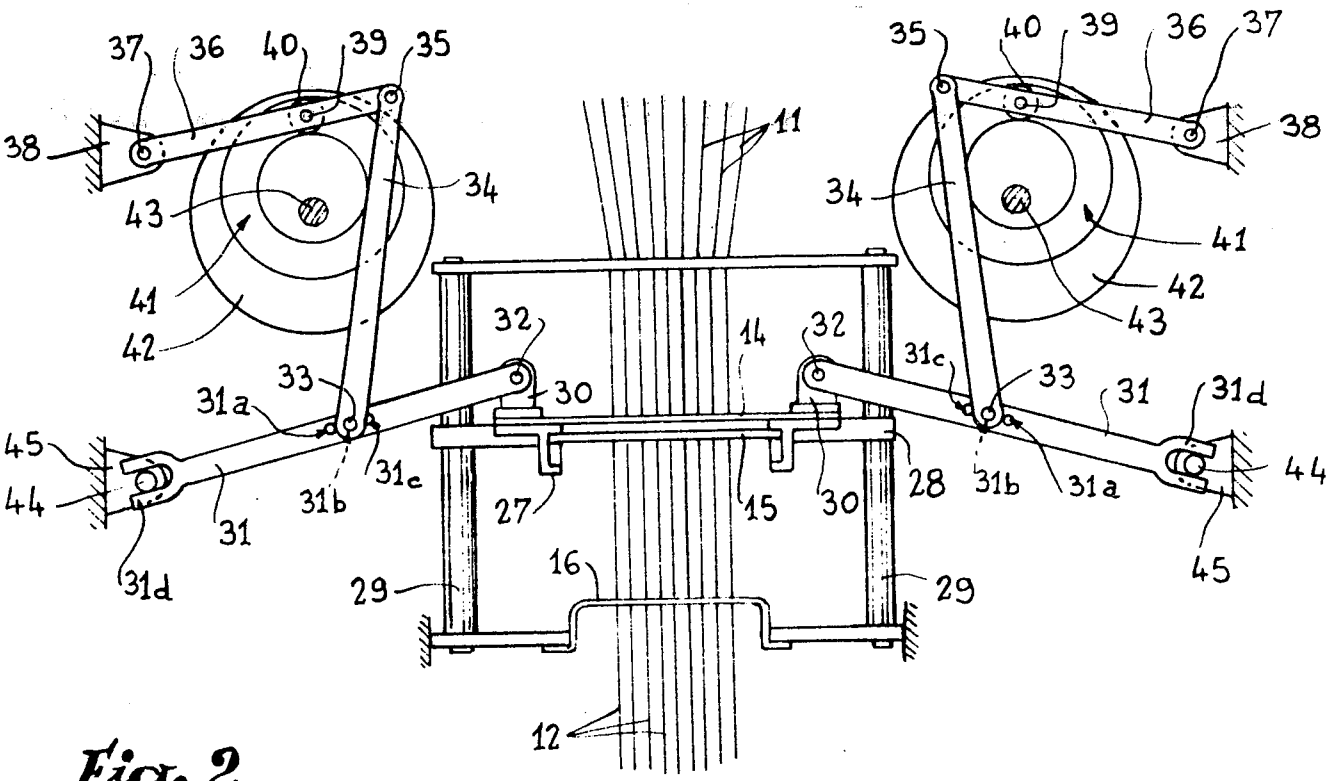

FIG. 2 shows each of the mechanisms adapted to raise the plates 14 and 15 together and then to lower them, and which are located at intervals in the transverse sense with respect to the loom. These plates are held by means of a frame 27 comprising a chassis 28 adapted to be guided vertically with respect to vertical stationary columns 29. The chassis 28 is provided with two lugs 30 disposed opposite each other and with respect to each of which a lever 31 is pivoted via a shaft 32. The central part of the lever is provided with several perforations 31*a*–31*c* in one of which is engaged a spindle 33 which constitutes articulation for the end of a small rod 34 of which the other end is pivoted via a shaft 35 on a lever 36 oscillating about a stationary shaft 37 fast with a fork joint 38 fixed to the frame of the machine. Between its ends, the lever 36 carries a shaft 39 about which a roller 40 is mounted to rotate freely so that it may engage in a groove 41 of a cylindrical cam 42 fixed on a shaft 43. In addition, the end of the lever 31*d* opposite the lug 30 is provided to be forked so that it may cooperate with a fixed pin 44 fast with a lug 45 fast with the frame of the machine.

Operation is as follows:

The action of the needles 8 provokes the rise of the heddles selected. As their stops 17 may pass through the perforations 15*a* of the plate 15, these stops come between the plates 14 and 15. At this moment, the wheel 24 leaves the ramp 25*b* of the groove 25*a* of the cam so that the lever 20 pivots about its axis 21 to come into the position of FIG. 3. This displacement provokes the translation of the fork joint 18 in the direction of arrow F by cooperation of the end 20*a* of the lever 20 with the rollers 19. The translation of the plate 15 imprisons the stops 17 of the heddles 12 which have been selected, between the plates 14 and 15 due to the change of position of the perforations 15*a*.

The upward displacement of the plates 14 and 15 due to the mechanism of FIG. 2 therefore necessarily takes along the heddles previously selected further to the locking of their stops 17 (FIG. 4). It will be noted that, as the lever 20 is then exactly vertical, the upward displacement of the assembly of the plates 14 and 15 (arrow F1 in FIG. 4) has no influence on the position of the plate 15.

The perforations 31*a*, 31*b*, 31*c* make it possible to change the position of the spindle 33 so as to vary the opening of the shed by changing the stroke of the chassis 28.

It will be observed that the telescopic systems 13 are of such a length that they may completely absorb the stroke of the heddles without the harness changing orientation.

Figure 5:
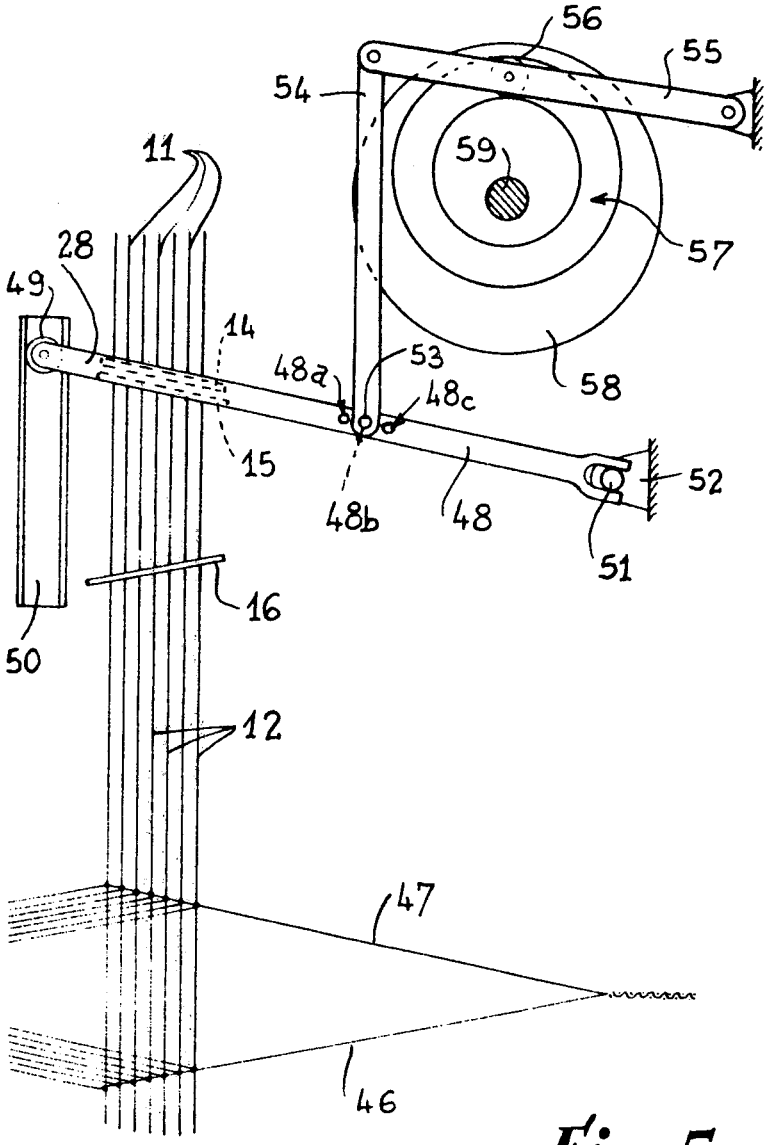
FIG. 5 is a schematic side view of a mechanism according to the invention allowing an oblique shed to be made.

As shown very schematically in FIG. 5, if the shed is oblique, i.e. when the warp threads are in the same plane 46,47 (fabric side) as that of the open shed, the principle described with reference to FIGS. 1 to 4 may also be applied according to the invention.

However, the mechanism for raising the plates 14, 15 is different since at rest, i.e. when the shed is closed, they are located in an oblique plane parallel to that at 46. Thus, it is a question of raising the plates 14 and 15 to the vertical from an oblique position to a likewise oblique position. To this end, the chassis 28 is associated with two levers 48 located on either side of the warp and one of the ends of which is provided with a wheel 49 cooperating with a vertical guide 50 whilst its other forked end cooperates with a horizontal pin 51 carried by a fixed clamp 52. The central part of the lever 48 is provided with perforations 48*a*, 48*b*, 48*c* in one of which is engaged a spindle 53 also passing through the end of a rod 54 of which the opposite end is pivoted on an oscillating lever 55 mounted identically to that 36 and which carries a roller 56 cooperating with a groove 57 made in a cam 58 fixed on a shaft 59. It will be readily understood that the rotation of the cam 58 provokes the pivoting of the lever 55 as well as that of the lever 48 about the pin 51 so that, alternately, the assembly of the plates 14,15 is raised and lowered whilst keeping the stops 17 of the selected heddles prisoner. Of course, as for the levers 31, the fork allows a slight axial clearance of the lever 48, whilst the perforations 48*a*, 48*b*, 48*c* ensure the adjustment of the stroke of the plates 14 and 15.

Of course, when the assembly composed of plates 14, 15 returns to its initial position, the stops 17 of the heddles are unlocked due to the rocking of the lever 20 of which the wheel 24 again cooperates with the ramp 25*b* so that the plate 15 is returned to its initial position of FIG. 1. The heddles are then subjected to a fresh selection.

Figure 6:
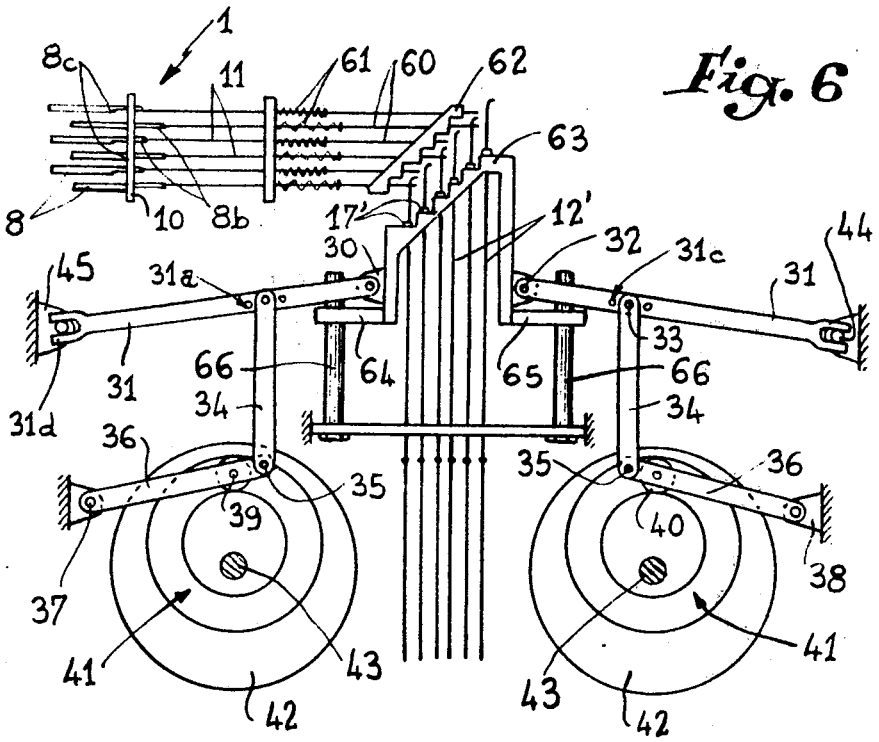
FIG. 6 illustrates a variant embodiment of the device shown in FIGS. 1 and 2.
Figure 7:
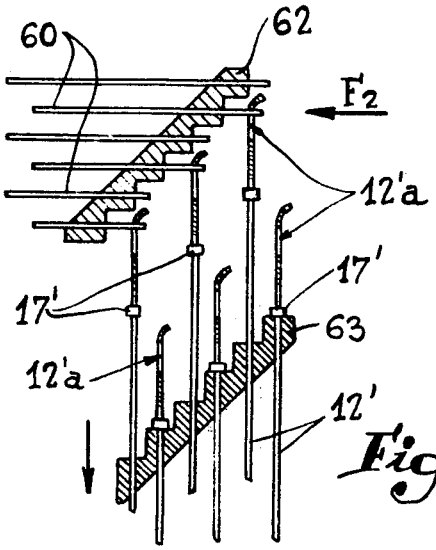
FIGS. 7 and 8 are detailed views on a larger scale.
Figure 8:
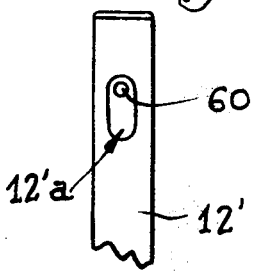

According to another embodiment shown in FIG. 6, the assembly 1 of FIG. 1 is disposed horizontally. The end of each needle 8 is associated in known manner with at least one harness cord 11 actuating a horizontal rod 60 against the reaction of a compression spring 61 which tends to push each rod 60 towards the heddles 12' and consequently to hold the shoulders 8*c* of the needles against the stationary plate 10. The rods 60 pass through an inclined plate 62. Of course, at rest, all the rods project by the same amount beyond this plate and they are engaged in an opening 12'*a* made in each of the heddles 12' which are oriented vertically (FIGS. 7 and 8). The heddles 12' are guided in an inclined lower frame 63 of which the upper face is stepped, each step having a heddle passing therethrough. All the heddles 12' are conventionally returned downwardly by means which have not been shown.

Operation is as follows:

The selected needles 8 move their rods 60 towards the left (arrows F2 of FIG. 7) so that their ends release the corresponding heddles as they are disengaged from the openings 12'*a* of these heddles. Said latter in contact by their stop 17' with the lower frame 63 follow the descending movement then rising movement of the latter, but on the other hand the non-selected heddles remaining suspended from their rods remain immobile.

The lower frame 63 is provided with squares 64,65 with unequal vertical arms and of which the horizontal arms cooperate with vertical guides 66. The squares 64,65 are each connected to a displacement mechanism such as the one shown in FIG. 2, and which ensures the descent and rise of the lower frame 63 in synchronism with the selection. When this lower frame has returned to its high position, the rods 60 are released and their springs 61 return them into position extended at maximum towards the right with respect to the plate 62 so that they penetrate in the openings 12'*a* of the heddles 12'. It will be noted that the upper end of the latter is slightly bent to facilitate cooperate thereof with the rods 60. When the lower frame 63 is in high position, the rods 60 are not in contact with the upper part of the openings 12'*a* but they are slightly below this part. Thus, the axial displacement of the rods is not counteracted by any antagonistic action whatsoever, and it may therefore be effected without effort. It is only right at the beginning of the downward displacement of the lower frame 63 that the non-selected heddles will be retained in high position by the rods 60.

It is obvious that the preceding description has only been given by way of example and that it does not limit the domain of the invention, variant embodiments being possible without departing from the scope thereof.

What is claimed is:

1. A device for controlling heddles connected for opening the shed in a weaving loom according to information taken from a Jacquard card by feeler means synchronized with the motion of the loom, comprising selecting means responsive to the Jacquard information for selecting a group of heddles and leaving another group non-selected; locking means moveable transversely of said heddles for locking one group of heddles and leaving the other group of heddles unlocked according to which group is selected; heddle displacing means synchronized with the motion of the loom and operative to displace said locking means longitudinally of the heddles to effect opening of the shed according to which heddles are selected and which are non-selected; a cam synchronized with the motion of the loom; a lever adjacent to the locking means and displaceable by the cam, the lever effecting transverse movements of the locking means and being oriented parallel to the displacement of the heddles when the displacing means is operative; and roller means carried by the locking means and in contact with the lever.

2. The device as claimed in claim 1, wherein the motion of the heddles and of the displacing means is vertical, and the lever is supported by a fixed pivot located between the roller means and the cam and is oriented vertically during displacement motions of the heddles.

3. The device as claimed in claim 1, wherein said locking means comprise two plates reciprocable together longitudinally of the heedles by said displacement means, and one plate being moveable transversely by said lever and roller means with respect to the other plate to lock and unlock said heddles.

4. The device as claimed in claim 3, wherein said heddle displacement means comprises a frame supporting said plates; means for guiding said frame for reciprocation longitudinally of the heddles; and a cam and lever mechanism synchronized with the motion of the loom and coupled to displace said frame on said guiding means.

5. The device as claimed in claim 3, wherein said plates are angled obliquely with respect to the longitudinal displacement of the heddles, whereby said shed is opened obliquely.

6. A device for controlling heddles connected for opening the shed in a weaving loom according to information taken from a Jacquard card by feeler means synchronized with the motion of the loom, comprising selecting means including multiple rods horizontally advanceable and retractable in response to the Jacquard information, the heddles being displaceable vertically along paths respectively intersecting adjacent ends of said rods; the rods and heddles having cooperative locking means by which the positions of the rods selectively lock one group of heddles and leave another group unlocked; and heddle displacing means synchronized with the motion of the loom and operative to displace the heddles upwardly to engage and lock those of said cooperative locking means which are associated with advanced rods and to leave unlocked the other locking means, and subsequently operative to displace downwardly the unlocked heddles to effect opening of the shed.

7. The device as claimed in claim 6, wherein the free ends of the rods extend horizontally through an upper frame and the adjacent ends of the heddles extend vertically through a lower frame, both frames being inclined so that the paths of the respective rods and heddles intersect along a path inclined with respect to the rods and the heddles, and the heddles having retaining stops thereon located to engage the top of the lower frame when the heddles are being displaced upwardly.

8. The device as claimed in claim 7, wherein each cooperative locking means for the heddles comprises an opening through each heddle near its upper end, and the free end of a cooperating rod which engages in the associated opening when the rod is advanced.

9. The device as claimed in claim 8, wherein the inclined lower frame is supported for vertical reciprocation in stationary guide means, and said heddle displacing means comprises a cam and lever mechanism with the lever coupled to displace said lower frame.

* * * * *